US006981886B1

(12) United States Patent
Co et al.

(10) Patent No.: US 6,981,886 B1
(45) Date of Patent: Jan. 3, 2006

(54) SLIDING LEVERED HANDLES ENGAGING AND PUSHING MEMORY MODULES INTO EXTENDER-CARD SOCKET

(75) Inventors: Ramon S. Co, Trabuco Canyon, CA (US); David Sun, Irvine, CA (US)

(73) Assignee: Kingston Technology Corp., Fountain Valley, CA (US)

( * ) Notice: Subject to any disclaimer, the term of this patent is extended or adjusted under 35 U.S.C. 154(b) by 0 days.

(21) Appl. No.: 10/906,319

(22) Filed: Feb. 14, 2005

Related U.S. Application Data

(63) Continuation-in-part of application No. 10/905,276, filed on Dec. 23, 2004.

(51) Int. Cl.
*H01R 13/62* (2006.01)

(52) U.S. Cl. ..... 439/160; 439/152

(58) Field of Classification Search ..... 439/160, 439/152
See application file for complete search history.

(56) References Cited

U.S. PATENT DOCUMENTS

| | | | | |
|---|---|---|---|---|
| 4,740,164 A | | 4/1988 | Schulz et al. | 439/64 |
| 4,986,765 A | | 1/1991 | Korsunsky et al. | 439/326 |
| 5,112,242 A | | 5/1992 | Choy et al. | 439/326 |
| 5,152,052 A | | 10/1992 | Rantala et al. | 29/764 |
| 5,309,325 A | * | 5/1994 | Dreher et al. | 439/160 |
| 5,366,390 A | | 11/1994 | Kinross et al. | 439/636 |
| 5,634,803 A | | 6/1997 | Cheng et al. | 439/157 |
| 5,892,660 A | | 4/1999 | Farnworth et al. | 361/728 |
| 6,371,781 B1 | | 4/2002 | Jones et al. | 439/260 |
| 6,629,855 B1 | | 10/2003 | North et al. | 439/325 |
| 6,705,882 B2 | | 3/2004 | Casses | 439/157 |
| 6,802,117 B2 | | 10/2004 | Dalisay | 29/758 |

* cited by examiner

*Primary Examiner*—Briggitte R. Hammond
(74) *Attorney, Agent, or Firm*—Stuart T. Auvinen

(57) ABSTRACT

A levered handle has an elongated slot that allows the levered handle to both slide and pivot over a pivot axis. The levered handle is slid over the pivot axis to allow a notch engager to engage a notch on a memory module. Then the notch engager is forced downward as the levered handle pivots upward about the pivot axis, causing a downward force to be applied to the notch on the memory module. This forces the memory module into a memory module socket. The memory module socket requires a reduced insertion force because the notch engager on the levered handle engages the notch on the memory module and applies downward pressure. A levered handle without the elongated slot can slide along the pivot axis perpendicular to the memory module to engage the notch. Both ejection and insertion forces can be reduced.

22 Claims, 11 Drawing Sheets

SLIDING LEVERED HANDLES ENGAGING AND PUSHING MEMORY MODULES INTO EXTENDER-CARD SOCKET

RELATED APPLICATION

This application is a continuation-in-part (CIP) of the co-pending application for "PC-MotherBoard Test Socket with Levered Handles Engaging and Pushing Memory Modules into Extender-Card Socket and Actuating Ejectors for Removal", U.S. Ser. No. 10/905,276, filed Dec. 23, 2004.

FIELD OF THE INVENTION

This invention relates to memory-module test sockets, and more particularly to memory-module test sockets with levered handles to aid module insertion.

BACKGROUND OF THE INVENTION

Memory modules such as dual-inline memory modules (DIMMs) are widely used in a variety of systems such as personal computers (PCs). Since profit margins for memory module manufactures are low, manufacturing costs must be reduced. Testing costs can be reduced by testing memory modules on a low-cost modified PC motherboard rather than an expensive electronic-component tester.

An extender card can be inserted into a memory module socket on a standard PC motherboard. This extender card has another memory module socket mounted on a top edge, while the bottom edge is inserted into the motherboard's memory module socket. The extender card effectively raises the location of the open memory module socket up off the surface of the motherboard, allowing easier access to the socket.

FIG. 1 shows a memory module extender card between a PC motherboard and a memory module being tested by the motherboard. Motherboard 26 has components 28 and memory module socket 18 mounted on a component side. Many components such as integrated circuit (IC) chips, resistors, capacitors, fans, connectors, and plugs can be mounted, and many motherboards have two or four memory module sockets 18.

Normally, memory module 10 is inserted directly in memory module socket 18 so that metal contacts 14 mate with metal contacts inside memory module socket 18. However, cables and components 28 may crowd around memory module socket 18, making it difficult to insert memory module 10. While module insertion is performed rarely in an end-user PC, when motherboard 26 is used to test memory modules, such restricted access is problematic.

Easier insertion of memory module 10 during such testing is provided by extender card 12. Metal contacts 24 on the bottom edge of extender card 12 are inserted into memory module socket 18. Metal traces on extender card 12 connect signals from metal contacts 24 to corresponding contacts inside extender socket 20.

During testing, memory module 10 is inserted into extender socket 20 on extender card 12. Since extender socket 20 is raised above memory module socket 18 on motherboard 26, socket access, and insertion and removal of memory module 10 are facilitated.

Some memory module sockets feature retention devices to lock the memory module into the socket. This prevents accidental loosening of the connection, or even loss of the memory module. For example, clip 22 on extender socket 20 can be moved inward to clip into notch 16 on memory module 10 after memory module 10 is fully inserted. Memory module socket 18 on motherboard 26 may also have such clips 22 for retention.

FIGS. 2A–B show operation of a retention clip on a memory module socket. Retention clip 22 is in the open position, moved outward and away from extender socket 20. Memory module 10 is inserted into extender socket 20 with retention clip 22 open, as shown in FIG. 2A. Notch 16 is lined up with retention clip 22 when memory module 10 is fully inserted into extender socket 20.

In FIG. 2B, retention clip 22 is moved inward, causing a knob on retention clip 22 to engage inside notch 16 on memory module 10. The knob on retention clip 22 engaging notch 16 prevents accidental removal of memory module 10.

However, memory module 10 must be fully inserted into extender socket 20 before retention clip 22 can be clipped into notch 16. A fair amount of force needs to be applied to memory module 10 by the user to insert memory module 10 fully into extender socket 20.

While insertion force may be significant, the force necessary for removal may be more difficult to apply, since it is a pulling rather than a pushing force. Some memory module sockets are equipped with ejectors to initially remove or start removal of an inserted memory module.

FIGS. 3A–B show operation of an ejector in a memory module socket. An extension of retention clip 22 may be formed below the fulcrum or pivot point of retention clip 22. This extension is normally hidden from view, inside extender socket 20. The extension of retention clip 22 is extension ejector 30 in FIGS. 3A–B.

When memory module 10 is fully inserted into extender socket 20, and retention clip 22 is clipped into notch 16, as shown in FIG. 3A, extension ejector 30 is in its lowest position, below memory module 10. The bottom (connector) edge of memory module 10 may touch a foot portion on the end of extension ejector 30.

To begin removal of memory module 10, a user pulls outward retention clip 22, as shown in FIG. 3B. As retention clip 22 is moved outward, extension ejector 30 pivots upward inside extender socket 20. The foot of extension ejector 30 pushes upward against the bottom edge of memory module 10, forcing memory module 10 upward out of extender socket 20. Typically extension ejector 30 only moves memory module 10 upward a slight distance, and the user finished removal of memory module 10 by pulling upward on it.

While such retention clips and extender cards are useful, a strong force is often needed to insert the memory module. When a technician or test operator has to manually force memory modules into test sockets, such forces can produce repetitive stress injuries or may damage the memory module, extender card, or motherboard tester. Often memory modules must be replaced every 2–5 minutes in a test or lab environment.

The parent application disclosed a memory module extender socket with levered handles that engaged the notches of a memory module to apply an insertion force onto the memory module. Further development by the inventors has produced a slidable handle.

DETAILED DESCRIPTION

The present invention relates to an improvement in memory module sockets. The following description is presented to enable one of ordinary skill in the art to make and use the invention as provided in the context of a particular application and its requirements. Various modifications to the preferred embodiment will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

The parent application disclosed using leverage to increase the user's force on a memory module during insertion. Rather than simply retaining the memory module in the socket after insertion, as retention clips do, levered handles apply downward force on a memory module before it is fully inserted. Thus insertion of memory modules into sockets is eased.

The inventors have further realized that the pivot of the levered handles may be a slidable pivot rather than a fixed pivot. The levered handle may slide along the pivot point, further aiding engagement of the notch engager with the notch on the memory module. In particular, the levered handle may slide along the pivot as the user inserts the notch engager into or out of the notch. The levered handle then pivots about the pivot axis without sliding to apply the insertion force.

Figure 1:
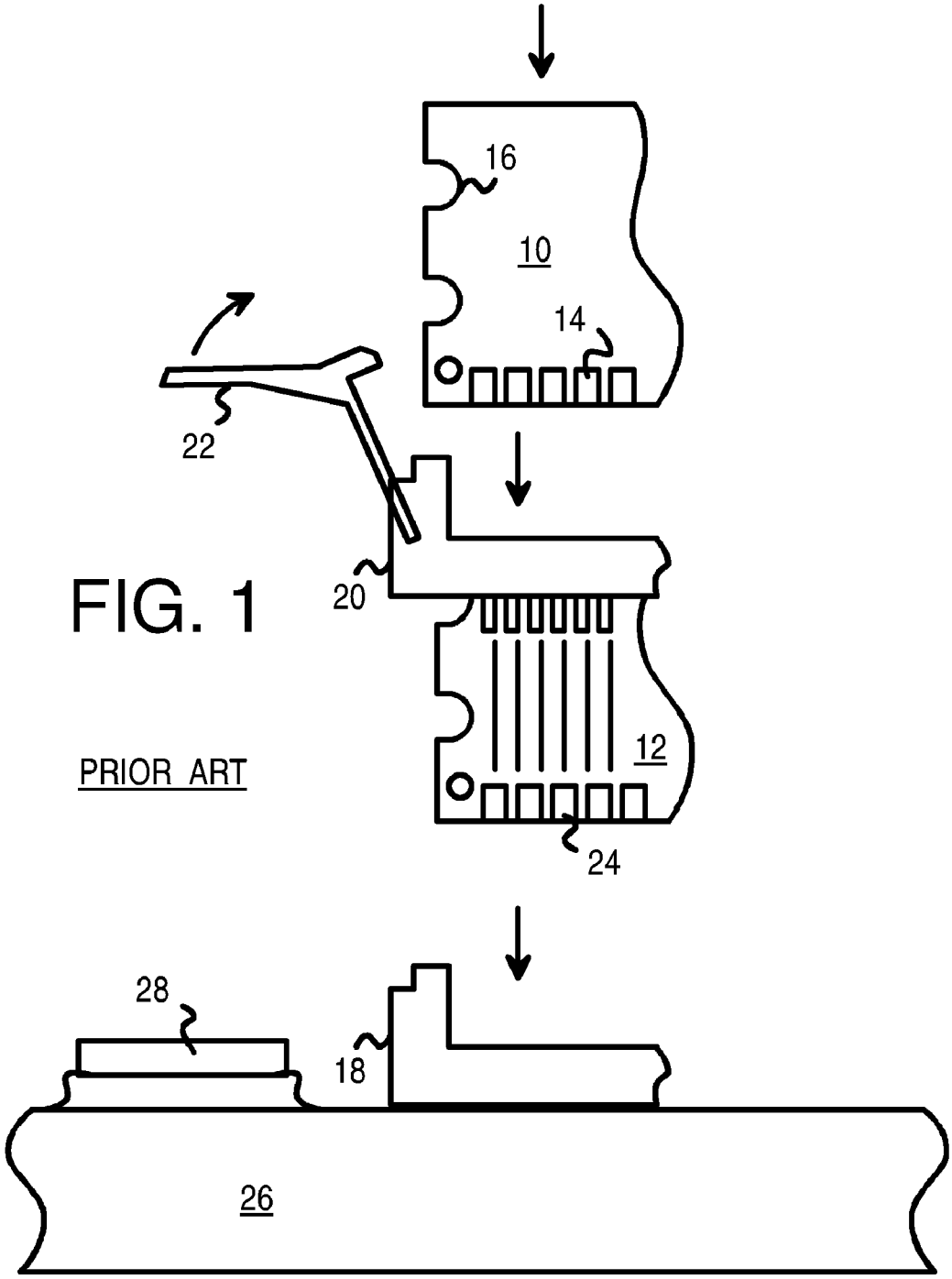
FIG. 1 PRIOR ART
FIG. 1 shows a memory module extender card between a PC motherboard and a memory module being tested by the motherboard.
Figure 2A:
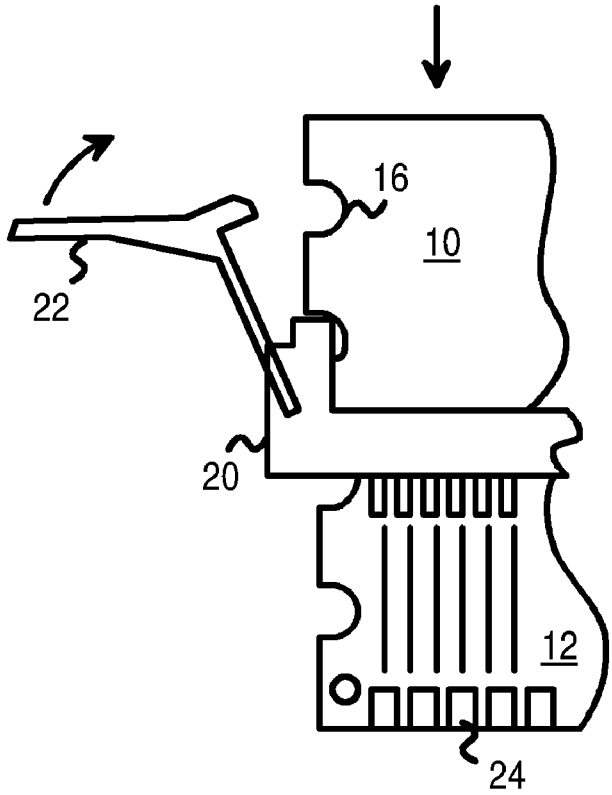
FIG. 2A PRIOR ART
FIGS. 2A–B show operation of a retention clip on a memory module socket.
Figure 2B:
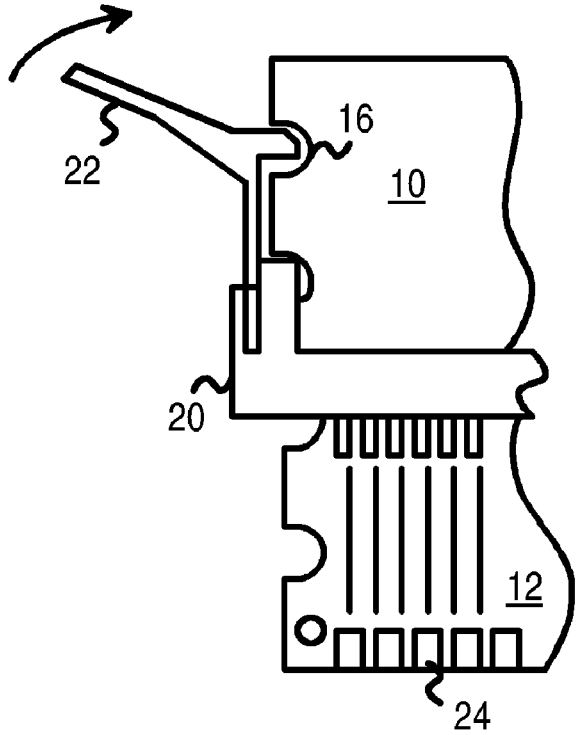
FIG. 2B PRIOR ART
Figure 3A:
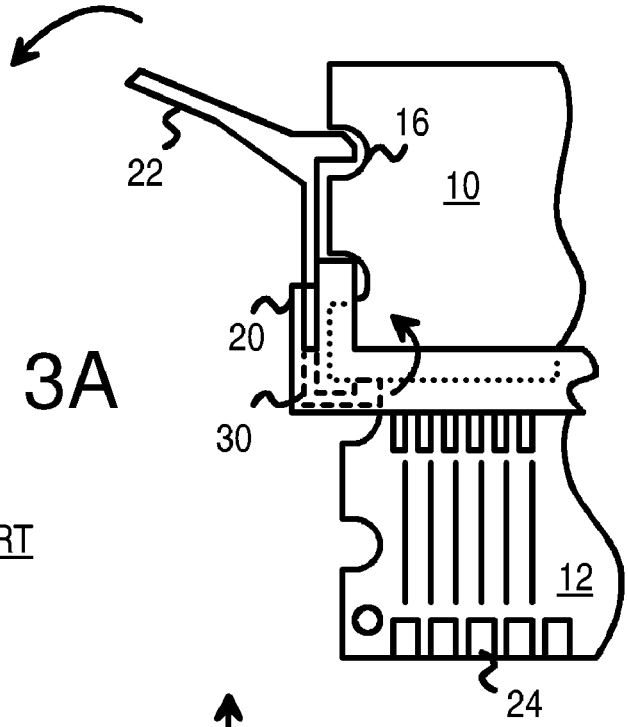
FIG. 3A PRIOR ART
FIGS. 3A–B show operation of an ejector in a memory module socket.
Figure 3B:
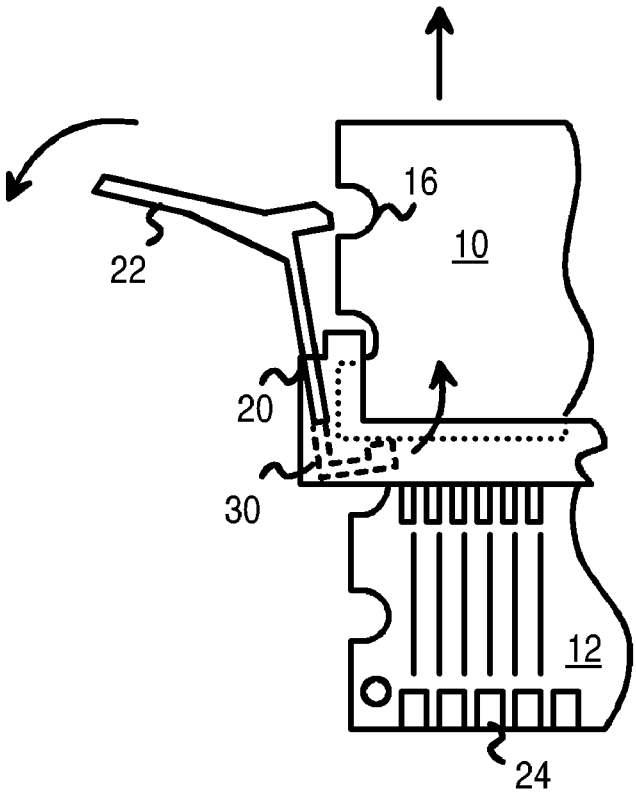
FIG. 3B PRIOR ART
Figure 4A:
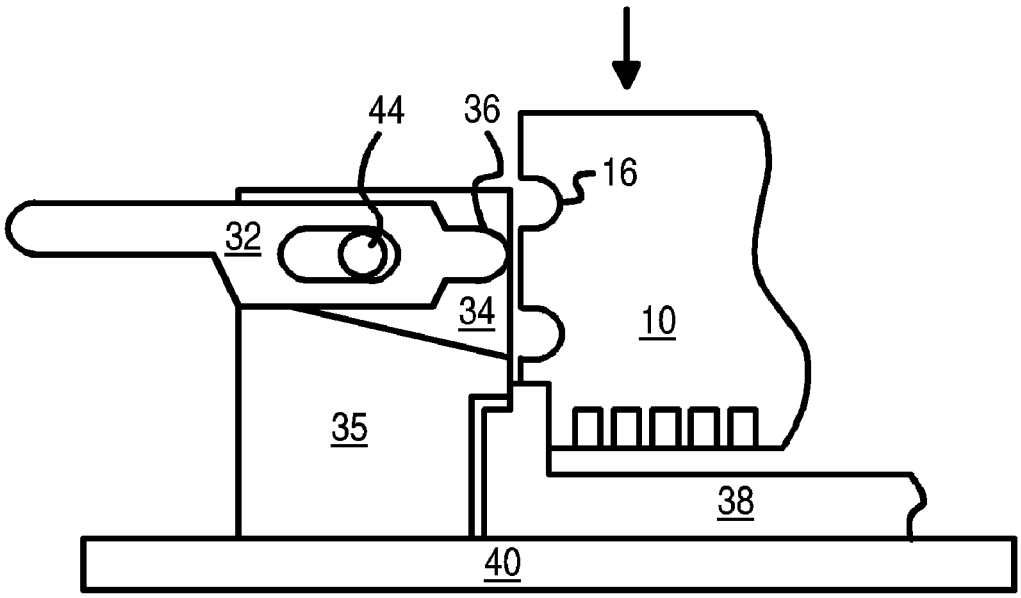
FIGS. 4A–C illustrate operation of a sliding leveraged handle to apply an insertion force on a memory module being inserted into a memory module socket.
Figure 4B:
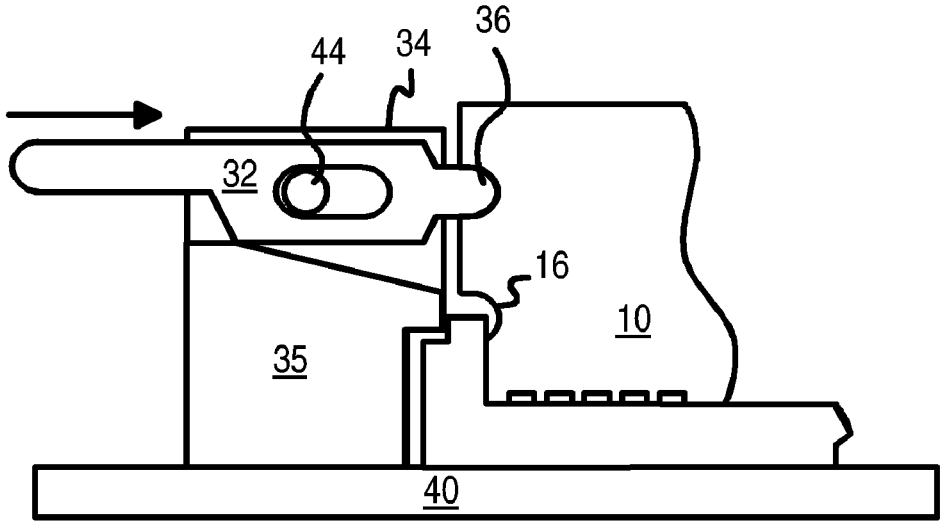
Figure 4C:
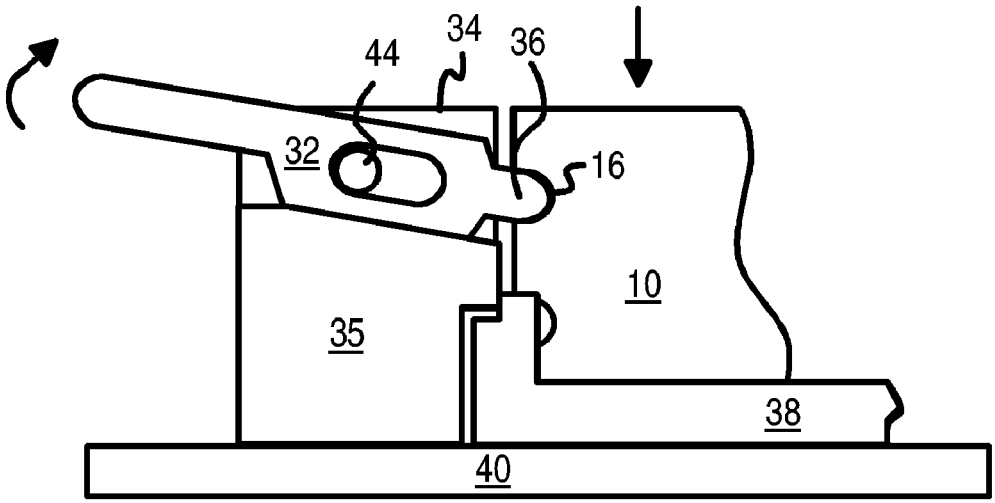

FIGS. 4A–C illustrate operation of a sliding leveraged handle to apply an insertion force on a memory module being inserted into a memory module socket. In FIG. 4A, memory module 10 is partially inserted by a user into a slot opening in memory module socket 38. Guides along the sides of memory module socket 38 may guide memory module 10 into position.

Mount 34 is fixed relative to memory module socket 38 and has pivot axis 44 which is also fixed relative to mount 34. However, levered handle 32 has an elongated slot that fits over pivot axis 44, allowing levered handle 32 to slide along pivot axis 44.

In FIG. 4A, levered handle 32 has been pulled out, away from memory module 10, and has slid along pivot axis 44 so that levered handle 32 is in the fully opened position.

Notch engager 36 is formed on levered handle 32 and is initially slid away from memory module 10 being inserted into memory module socket 38. During insertion, memory module 10 is pushed into memory module socket 38 by a user so that notch 16 on memory module 10 is opposite notch engager 36 and at about the same level. As shown in FIG. 4A, memory module 10 has not yet be inserted this far.

With memory module 10 inserted a proper amount into memory module socket 38, notch 16 aligns with notch engager 36 when levered handle 32 is slid inward along pivot axis 44. If notch 16 on memory module 10 is too high relative to notch engager 36, then the user can push memory module 10 farther down into memory module socket 38 until notch 16 aligns with notch engager 36.

The handle side of levered handle 32, opposite from notch engager 36, can be longer or heavier so that the handle side of levered handle 32 naturally rests on a flat landing portion of handle aligner 35, which is part of mount 34. Thus the position of levered handle 32 shown in FIG. 4A is known as the rest position.

In FIG. 4B, levered handle 32 is slid toward memory module 10 by the user. The elongated slot on levered handle 32 allows levered handle 32 to slide along pivot axis 44. Notch engager 36 fits into notch 16 on memory module 10 as levered handle 32 is slid inward toward memory module 10.

In FIG. 4C, levered handle 32 is pivoted upward around its pivot point, axis 44 on mount 34. The far end of levered handle 32 if lifted by the user, causing notch engager 36, on the opposite side of the fulcrum of pivot axis 44, to be moved downward.

The bottom of notch engager 36 begins to push against the bottom of notch 16 as levered handle 32 is lifted. As levered handle 32 is rotated further, memory module 10 is forced downward, farther into memory module socket 38.

After levered handle 32 has been rotated the full amount, memory module 10 is fully inserted into memory module socket 38. Good electrical contact is made between the metal contacts on memory module 10 and those in memory module socket 38.

While the amount of downward movement of memory module 10 as levered handle 32 is rotated may appear to be small, as shown by comparing the locations of memory module 10 in FIGS. 4B and 4C, this portion of module insertion often required the greatest force as the metal contacts rub together and make their tightest fit. Thus the user is spared from direct application of the greatest force by use of levered handle 32. Due to its leveraging ability, levered handle 32 multiplies the force applied by the user, resulting in a greater force applied to memory module 10 by notch engager 36 than the user applies to the end of levered handle 32. Of course, should the user hold levered handle 32 in the middle of its arm, rather than the far end, the amount of leverage is reduced, and the user must apply greater force.

Figure 5:
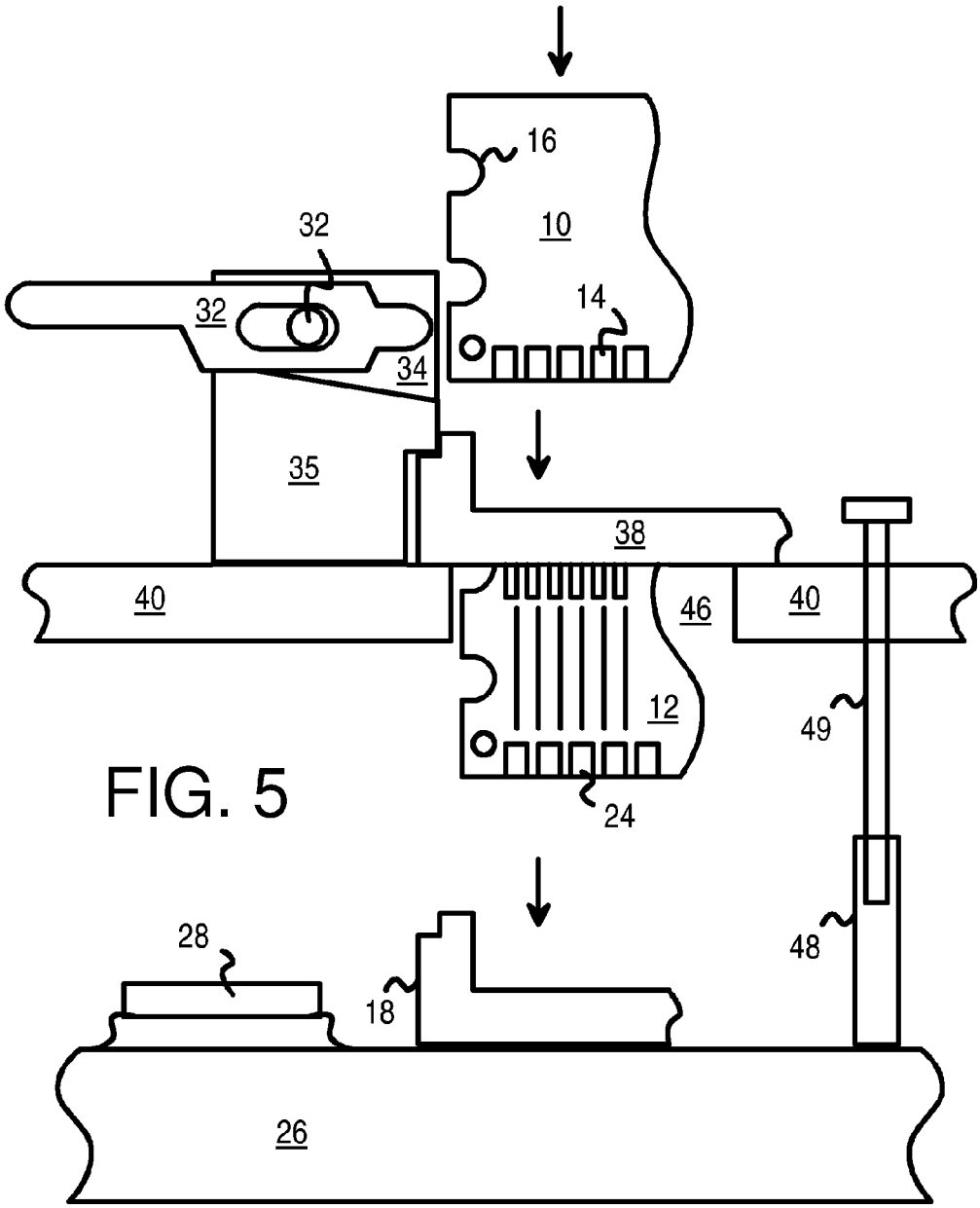
FIG. 5 shows a test adapter board with an extender card and a sliding levered handle for aiding insertion of memory modules.

While levered handle 32, notch engager 36, and mount 34 may be part of or mounted next to a standard memory module socket, such as a socket on a PC motherboard, one embodiment uses them as part of a test adapter board. FIG. 5 shows a test adapter board with an extender card and a sliding levered handle for aiding insertion of memory modules.

Levered handle 32, shown in its open position, is slid along pivot axis 44 toward memory module 10, causing notch engager 36 to engage notch 16 in memory module 10 when memory module 10 is inserted a proper, partial amount into memory module socket 38. As levered handle 32 is lifted upward by a user to rotate about pivot axis 44 on mount 34, the force exerted by notch engager 36 onto notch 16 forces memory module 10 downward so that metal contacts 14 mate with contacts inside memory module socket 38.

Only the left end of memory module socket 38 is shown. Another slidable levered handle 32 mounted to another mount 34 are on the right end of memory module socket 38 and apply force on that right end of memory module 10 in a similar fashion. These right-side elements are not shown, but can be seen in FIG. 7.

Mount 34 and handle aligner 35 are mounted to base board 40, which can be attached above motherboard 26 by several standoffs 48. Screw or bolt 49 can fit through a hole in base board 40, through a hollow center of standoff 48, and through another hole in motherboard 26. Other kinds of board attachments can be substituted for standoffs 48.

Standoffs 48 and the height of extender card 12 can be made tall enough to allow for sufficient clearance or space between base board 40 and motherboard 26 so that components 28 have enough air flow for cooling.

Memory module socket 38 is part of extender card 12, being attached to an upper edge of extender card 12. The lower edge of extender card 12 has metal contacts 24, which fit inside memory module socket 18 on motherboard 26. Extender card 12 fits in opening 46 in base board 40. Opening 46 is wider than extender card 12, but not as wide as memory module socket 38, allowing the ends of memory module socket 38 to rest on the upper surface of base board 40 around opening 46.

A bar or protrusion extending from handle aligner 35 on mount 34 can fit in a notch on the ends of memory module socket 38 as shown, to hold memory module socket 38 down on the top surface of base board 40. Memory module socket 38 and extender card 12 can be held firmly in place to base board 40, which can then be lowered into position over motherboard 26, as metal contacts 24 of extender card 12 are fitted into memory module socket 18.

Figure 6A:
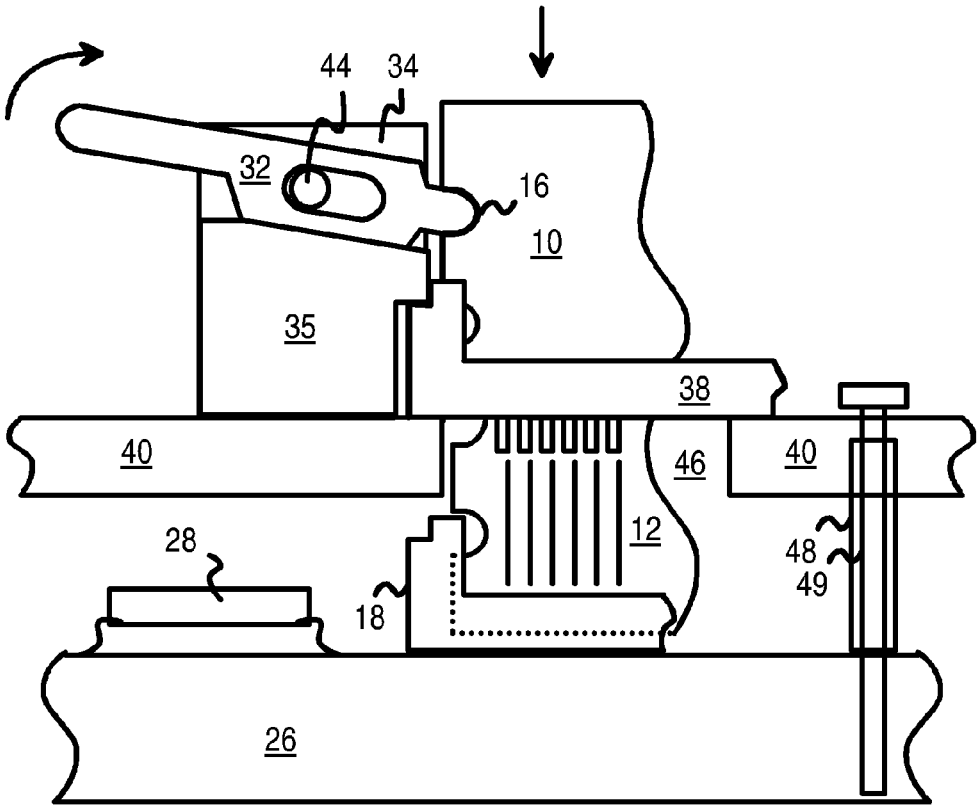
FIGS. 6A–B show operation of the sliding levered handle on a test adapter board.
Figure 6B:
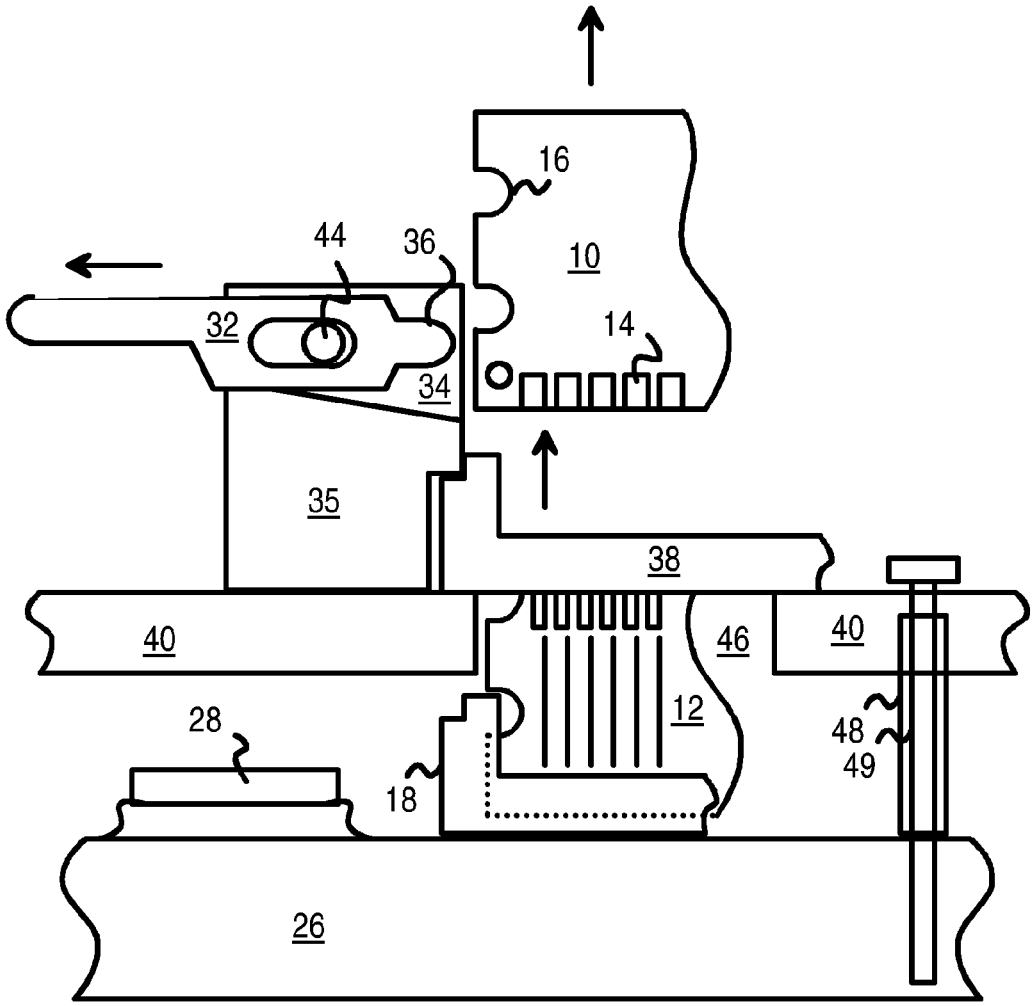

FIGS. 6A–B show operation of the levered handle on a test adapter board. Base board 40 is shown mounted to motherboard 26 by standoffs 48 and bolt 49. Three, four, or more of such standoffs 48 may be used, preferably using existing holes on motherboard 26. Levered handle 32 operates as described before, sliding along pivot axis 44 causing notch engager 36 to engage notch 16. As levered handle 32 is rotated around pivot axis 44, notch engager 36 applies downward force on memory module 10, forcing it into memory module socket 38. In FIG. 6A memory module 10 is fully inserted.

During ejection, FIG. 6B, the user pushes down on the end of levered handle 32, causing it to rotate about pivot axis 44. Notch engager 36 pulls upward on notch 16. As levered handle 32 is pushed downward, notch engager 36 applies an upward force on the bottom edge of notch 16 on memory module 10. Memory module 10 is forced out of memory module socket 38 by a slight amount. Since the greatest ejection force is often the initial movement of memory module 10, this initial ejection reduces the force required of the user to pull memory module 10 completely out of memory module socket 38. The user then slides levered handle 32 outward along pivot axis 44 to disengage notch engager 36 from notch 16. Memory module 10 can then be fully removed by the user.

Levered handle 32, which applies an insertion force through notch engager 36, reduces the force the user applies to memory module 10. This can reduce the possibility of injuries to the user, such as repetitive-stress injuries.

Sliding levered handle 32 along pivot axis 44 allows notch engager 36 to be better and more fully and securely inserted into notch 16. The better fit of notch engager 36 into notch 16 prevents levered handle 32 from dislodging or disengaging from memory module 10 as levered handle 32 is rotated around pivot axis 44. This results in more reliable operation. Subsequently, a single levered handle 32 can be used for both insertion and ejection of memory module 10.

Figure 7:
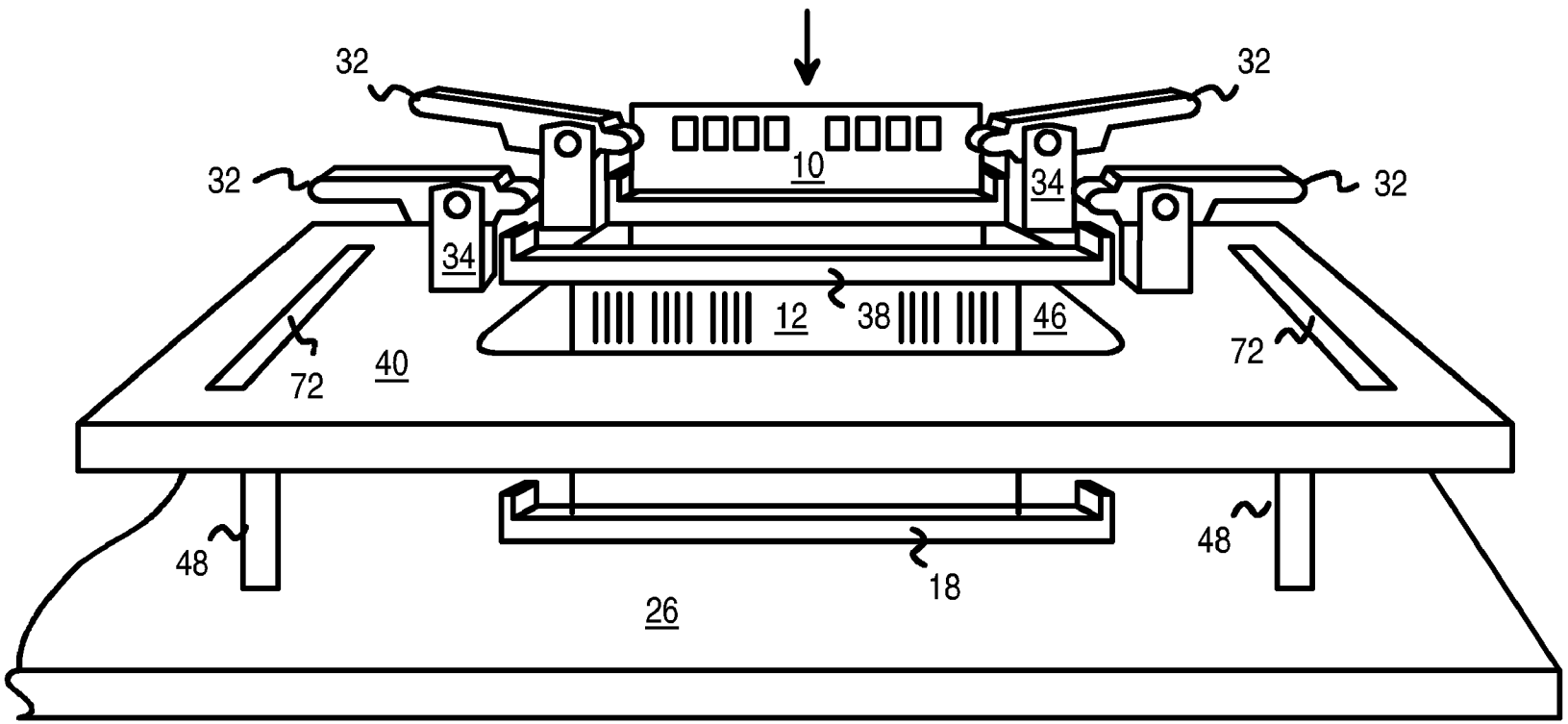
FIG. 7 is a perspective view of a motherboard tester with the test adaptor board with sliding levered handles to ease insertion of memory modules.

FIG. 7 is a perspective view of a motherboard tester with the test adaptor board with sliding levered handles to ease insertion of memory modules. Test programs that test memory can be executed on motherboard 26, such as memory tests during boot-up or more extensive tests run after initialization. A memory module is normally inserted into memory module socket 18 in a standard PC, but instead extender card 12 is inserted into memory module socket 18. The top of extender card 12 has memory module socket 38 that receives memory module 10 for testing.

More than one memory module 10 may be tested at a time. A second extender card 12 with a second memory module socket 38 can also be supported by base board 40. Two pairs of levered handles 32 can be fitted on mounts 34, each pair engaging a notch 16 on a different memory module 10 being inserted into a different memory module socket 38. In another embodiment, each levered handle 32 can engage two memory modules 10, with two memory module sockets 38 for each pair of levered handles 32. One opening 46 can have four extender cards 12, or two or more separate openings 46 may be used.

The elongated slot on levered handle 32 that fits over pivot axis 44 may be hidden by the sides of mount 34 as shown when mount 34 surrounds pivot axis 44 and levered handle 32 on the sides.

Ribs 72 may be formed on base board 40. Ribs 72 may fit inside a heater cover (not shown) that can be placed over memory modules 10 when inserted into memory module sockets 38. The heater cover and base board 40 form a heat chamber that allows memory modules 10 to be heated and tested at an elevated temperature. The heater cover could also be attached to base board 40 by a hinge.

Figure 8A:
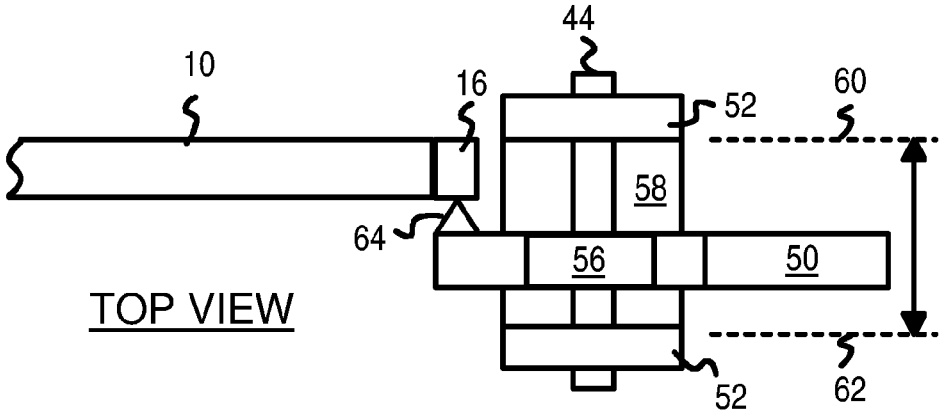
FIGS. 8A–B show an alternate embodiment of the sliding levered handles that slide in a perpendicular direction.
Figure 8B:
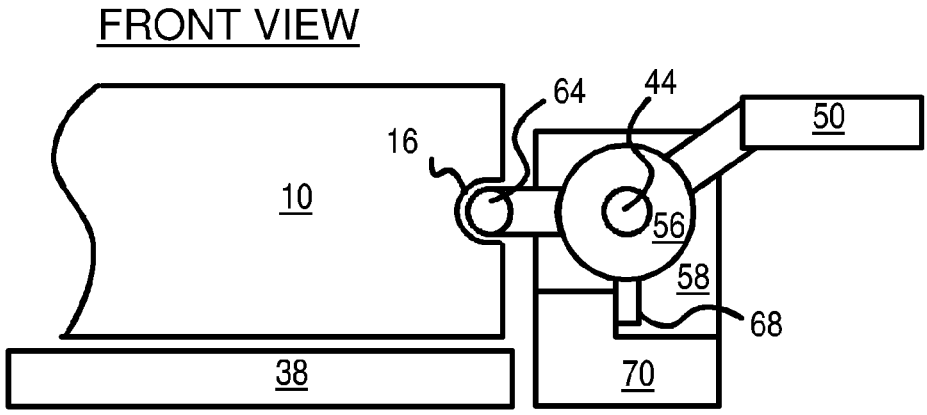

FIGS. 8A–B show an alternate embodiment of the sliding levered handles that slide in a perpendicular direction. Rather than sliding the levered handle horizontally toward the memory module, the sliding motion may be in other directions. In this embodiment, the levered handle is slid in a perpendicular direction to the plane of the memory module to engage the notch.

FIG. 8A is an overhead view with memory module 10 edge-on as it is being inserted into memory module socket 38. Levered handle 50 is not in the same plane as memory module 10 but is offset. Levered handle 50 pivots about pivot axis 44, which is a rod attached to mount 58.

Levered handle 50 can slide along pivot axis 44 as shown by the arrow in FIG. 8A. Sliding ring 56 is fixedly attached to levered handle 50 but slides along pivot axis 44. Levered handle 50 can slid along pivot axis 44 to open position 62, and to engaged position 60. Portions of mount 58 act as stoppers 52, restricting movement past positions 60, 62 by limiting movement of sliding ring 56.

When levered handle 50 is in open position 62, conical notch engager 64 is outside of notch 16. As levered handle 50 is slid along pivot axis 44 to engaged position 60, conical notch engager 64 slides into notch 16 to engage the memory module notch.

FIG. 8B is a front view. Conical notch engager 64 is engaged with notch 16 of memory module 10. Levered handle 50 rotates around pivot axis 44 along with sliding ring 56. Rotating stop 68 is a protrusion of sliding ring 56 on levered handle 50 that is stopped by base stop 70, which stops excess rotation of levered handle 50 once memory module 10 has been lifted out of memory module socket 38.

Figure 9:
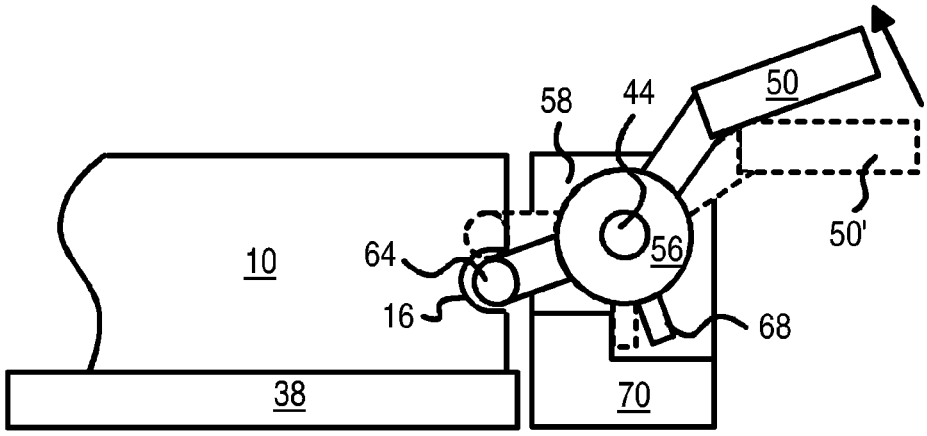
FIG. 9 shows rotation of the levered handle during insertion of a memory module.

FIG. 9 shows rotation of the levered handle during insertion of a memory module. Levered handle 50 is fixed to sliding ring 56 which are slid toward the plane of the drawing page to engage conical notch engager 64 into notch 16 of memory module 10. The user then pulls upward on the end of levered handle 50 in position 50', causing it and sliding ring 56 to rotate about pivot axis 44. This rotation upward on the handle end of levered handle 50 causes a downward force on the opposite end of the fulcrum, pivot axis 44. This downward force is applied to conical notch engager 64 by levered handle 50 and thru conical notch engager 64 to notch 16, causing memory module 10 to be pushed downward into memory module socket 38.

In the initial position 50', rotating stop 68 touches a step in base stop 70, which holds levered handle 50 in the initial position as the user first aligns and partially inserts memory module 10 into memory module socket 38. For removal of memory module 10, the user pushes downward on the end of levered handle 50, causing an upward force to be applied by conical notch engager 64 on notch 16, ejecting memory module 10 slightly from memory module socket 38. Further rotation of levered handle 50 can be stopped by rotating stop 68 contacting base stop 70.

Figure 10:
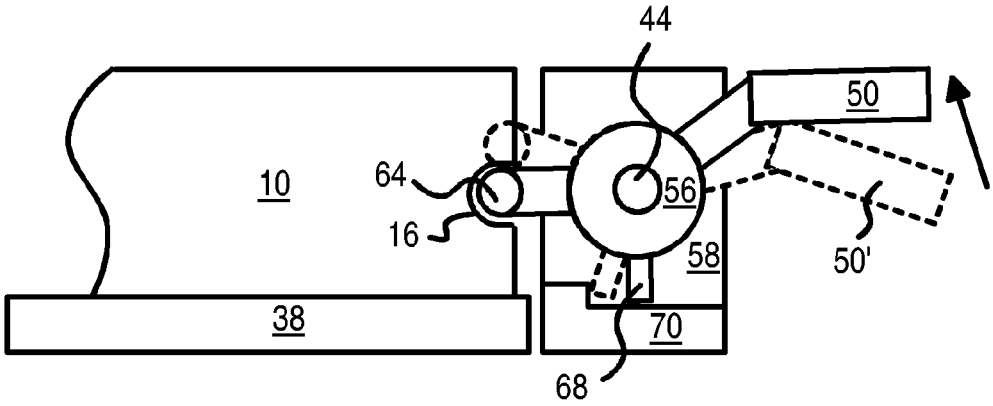
FIG. 10 is another embodiment with a different rotating stop.

FIG. 10 is another embodiment with a different rotating stop. The exact location of rotating stop 68 may be shifted to a variety of locations, such as the example shown in FIG. 10. The location of the step on base stop 70 can be adjusted so that a desired amount of rotation of levered handle 50 occurs before being stopped. Base stop 70 can be a part of mount 58.

ALTERNATE EMBODIMENTS

Several other embodiments are contemplated by the inventors. For example mount 58 and base stop 70 may be molded together or may be separate and can have a variety of shapes and forms. Base board 40 may have a variety of shapes and have various cutouts and openings 46 to fit extender cards 12 and components on motherboard 26 that protrude above base board 40. Base board 40 may be made from a thicker, more insulating material or fiberglass to improve the heat chamber.

While engagement of notch engager 36 or conical notch engager 64 with an upper notch 16 of memory module 10 has been shown, engagement with a lower notch or other feature of a memory module could occur with an appropriate position and design of levered handle 32, axis 44, and notch engager 36. Rotations of different amounts such as 10, 30 or 45 degrees can be designed for by changes to levered handle 32, mount 34, notch engager 36, and their positions relative to notch 16 and memory module socket 38. The length or levered moment arm of levered handle 32 or 50 may be increased or decreased, changing the leverage efficiency.

Rotating stop 68 and base stop 70 may not be necessary in some embodiments. Levered handle 50 may remain in the initial open position without a stop. The initial, open position of levered handle 50 may not be exactly aligned with notch 16, but may be at an angle, such as a slight upward angle, increasing the rotational movement during insertion. The angle to notch 16 may be allowed to vary, allowing the user to partially insert memory module 10 into memory module socket 38 by varying amounts.

More than one memory module socket may be used on base board 40. Each levered handle 32 could engage just one notch on one memory module, or notch engager 36 could have an elongated depth (the direction normal to the plane of FIG. 5) so that notches on two or more memory modules could be engaged simultaneously. Several levered handles 32 could also be ganged together so that multiple memory modules are acted upon at the same time.

Various other enhancements can be made, such as locks, stops, bumps, ridges, or holding mechanisms for holding levered handle 32 in its various positions. The levered handles could be attached to a base that is attached directly to a memory module socket, without using a base board 40. The levered handles have application in non-tenting environments as well, such as on consumer PC motherboards.

Positions such as up, down, etc. are relative and may be interchangeable, such as when the socket is transformed or re-positioned. The levered handle can be made from a variety of materials such as metal or rigid plastic. The notch engager and other components can be integral with the levered handle or attached to the levered handle.

A bar portion of handle aligner 35 (see FIG. 5) may be used to hold down memory module socket 38, or a screw (not shown) horizontally through mount 34 can attach to the side of memory module socket 38 to hold memory module socket 38 and extender card 12 in place on base board 40 or on a motherboard. Memory module socket 38 could be mounted to base board 40 or to mount 34 in a variety of other ways, such as by adhesive, clamps, screws or bolts in various locations, etc. The shape and size of opening 46 can vary, such as one or more long rectangles or ovals to closely fit one or more extender cards 12, or other shapes.

The handle aligner could have many shapes and forms and could be deleted. The handle aligner may be separate from mount 34 or may be a part of mount 34 or mount 58. Various ridges, stops, grooves, etc. could perform the function of stopping movement of levered handle 32 or 50 when the memory module is fully inserted, or of holding levered handle 32 or 50 in the open position or in some other position. Sliding ring 56 may be part of levered handle 50 and may have shapes other than ring shapes. Sliding ring 56 may simply be a center portion of levered handle 50 around a hold for the pivot axis.

An ejector foot may be added as described in the parent application. The ejector foot may be pushed downward by the bottom edge of memory module 10 when fully inserted, causing the ejector arm to be in the upright position shown in FIG. 6A of the parent application. The ejector foot and ejector arm are on opposite sides of an ejector pivot, which can be an axis such as a bolt, as can axis 44 of levered handle 32.

The ejector could be pushed by levered handle 32 or could be attached to levered handle 32. Conical notch engager 64 could have shapes other than conical, such as being a cylinder, a semi-sphere, or a point. The conical shape may be only part of a full cone, such as half of a cone. A rod may be used for pivot axis 44, or some other shape may be used.

Any advantages and benefits described may not apply to all embodiments of the invention. When the word "means" is recited in a claim element, Applicant intends for the claim element to fall under 35 USC Sect. 112, paragraph 6. Often a label of one or more words precedes the word "means". The word or words preceding the word "means" is a label intended to ease referencing of claims elements and is not intended to convey a structural limitation. Such means-plus-function claims are intended to cover not only the structures described herein for performing the function and their structural equivalents, but also equivalent structures. For example, although a nail and a screw have different structures, they are equivalent structures since they both perform the function of fastening. Claims that do not use the word "means" are not intended to fall under 35 USC Sect. 112, paragraph 6. Signals are typically electronic signals, but may be optical signals such as can be carried over a fiber optic line.

The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A memory module socket comprising:

a memory module connector socket having a slot for receiving a connector edge of a memory module, the slot having metal contacts for contacting metal contacts by the connector edge of the memory module;

the memory module connector socket having a middle portion having the slot and having end portions on opposing sides of the middle portion;

a levered handle pivoting near the end portion of the memory module connector socket;

an axis of the levered handle, the levered handle pivoting around the axis in an insertion direction, the levered handle also sliding over the axis in a sliding movement; and a notch engager on the levered handle, the notch engager positioned to engage a notch on an edge of the memory module when the memory module is partially inserted and the levered handle is slid over the axis in the sliding movement;

wherein the notch engager exerts a downward force on the notch of the memory module when the levered handle is pivoted around the axis in the insertion direction, the downward force on the notch causing the memory module to be forced into the slot of the memory module connector socket;

whereby the memory module is forced into the slot by the notch engager on the levered handle being pivoted in the insertion direction.

2. The memory module socket of claim 1 wherein the notch engager exerts an upward force on the notch of the memory module when the levered handle is pivoted around the axis in an ejection direction that is opposite to the insertion direction, the upward force on the notch causing the memory module to be forced out of the slot of the memory module connector socket.

3. The memory module socket of claim 2 wherein a force applied by a user to an end of the levered handle is multiplied by leverage to create the downward and upward force that the notch engager exerts on the notch of the memory module.

4. The memory module socket of claim 3 further comprising:

an elongated slot on the levered handle, the elongated slot surrounding the axis, the axis sliding along the elongated slot when the levered handle is slid over the axis to fit the notch engager into the notch; and whereby the elongated slot allows the levered handle to slide over axis.

5. The memory module socket of claim 3 further comprising:

a sliding ring on the levered handle, the sliding ring having a hole that the axis fits into, the sliding ring sliding along the axis;

wherein the notch engager moves in a direction substantially perpendicular to a plane of a component surface of the memory module when the notch engager is inserted to fit into the notch.

6. The memory module socket of claim 5 wherein the notch engager has a conical shape.

7. The memory module socket of claim 5 further comprising:

an extender card having the memory module connector socket mounted on a top edge, and a connector edge having metal contacts for insertion in a memory module socket on a personal computer motherboard; and a base board having the end portions of the memory module connector socket mounted thereon, the base board having an opening under at least part of the middle portion of the memory module connector socket, the opening for the extender card to pass through to reach a memory module socket on a motherboard below the base board.

8. A test apparatus comprising:

socket means for receiving a connector edge of a memory module;

motherboard means for executing test programs to test the memory module, the motherboard means having a memory module socket;

extender card means for electrically connecting contacts inside the socket means to metal contacts on a card connector edge of the extender card means, the card connector edge for insertion into the memory module socket on the motherboard means;

base board means, mounted above the memory module socket on the motherboard means and having an opening directly above the memory module socket, for supporting the socket means above the motherboard means;

first levered handle means for pivoting about and sliding over a first axis;

first mount means, mounted to the base board means by a first end of the socket means, for supporting the first levered handle means at the first axis; and first notch engage means, fixedly coupled to the first levered handle means, for engaging a first notch on the memory module when the first levered handle means is slid over the first axis;

wherein the first notch engage means applies an insertion force on the first notch when the first levered handle means is pivoted about the first axis in a first insertion direction, the insertion force forcing the connector edge of the memory module into the socket means, whereby the insertion force is produced by pivoting the first levered handle means in the first insertion direction.

9. The test apparatus of claim 8 further comprising:

second levered handle means for pivoting about and sliding over a second axis;

second mount means, mounted to the base board means by a second end of the socket means, for supporting the second levered handle means at the second axis; and second notch engage means, fixedly coupled to the second levered handle means, for engaging a second notch on the memory module when the second levered handle means is slid over the second axis;

wherein the second notch engage means applies an insertion force on the second notch when the second levered handle means is pivoted about the second axis in a second insertion direction, the insertion force forcing the connector edge of the memory module into the socket means.

10. The test apparatus of claim 9 further comprising:

first elongated slot means, on the first levered handle means and surrounding the first axis, for sliding along the first elongated slot when the first levered handle means is slid over the first axis to fit the first notch engage means into the first notch; and second elongated slot means, on the second levered handle means and surrounding the second axis, for sliding along the second elongated slot when the second levered handle means is slid over the second axis to fit the second notch engage means into the second notch;

whereby elongated slots allow levered handles to slide over axes.

11. The test apparatus of claim 10 wherein the first and second levered handle means slide in one or more planes substantially parallel to a plane of a component surface of the memory module when inserted.

12. The test apparatus of claim 9 wherein the first and second levered handle means slide in one or more planes substantially perpendicular to a plane of a component surface of the memory module when inserted.

13. The test apparatus of claim 12 further comprising:

first hole means, on the first levered handle means, for fitting over the first axis and for sliding along the first axis;

wherein the first notch engage means moves in a direction substantially perpendicular to the plane of the component surface of the memory module when the first notch engage means is inserted to fit into the first notch; and second hole means, on the second levered handle means, for fitting over the second axis and for sliding along the second axis;

wherein the second notch engage means moves in a direction substantially perpendicular to the plane of the component surface of the memory module when the second notch engage means is inserted to fit into the second notch.

14. A reduced-insertion-force memory module socket comprising:

a first supporting mount having a first axis;

a second supporting mount having a second axis substantially parallel to the first axis;

a memory module socket between the first and second supporting mounts, the memory module socket having its longest dimension between the first and second supporting mounts, the memory module socket having a slot for receiving a connector edge of a memory module;

a first levered handle slidingly connected to the first supporting mount by the first axis and rotating about the first axis;

a first notch engager on the first levered handle, the first notch engager fitting into a first notch on a first end of the memory module when partially inserted into the memory module socket and the first levered handle is slid over the first axis;

wherein the first notch engager is closer to the first axis than a handle end of the first levered handle, the handle end being farther from the memory module socket than the first notch engager when the memory module is fully inserted;

wherein the first notch engager applies a first insertion force onto the first notch after the first levered handle is slid over the first axis to fit the first notch engager into the first notch and the first levered handle is rotated in an insertion movement, the first insertion force forcing the connector edge of the memory module firmly into the slot of the memory module socket;

a second levered handle slidingly connected to the second supporting mount by the second axis and rotating about the second axis; and a second notch engager on the second levered handle, the second notch engager fitting into a second notch on a second end of the memory module when partially inserted into the memory module socket and the second levered handle is slid over the second axis;

wherein the second notch engager is closer to the second axis than a handle end of the second levered handle, the handle end being farther from the memory module socket than the second notch engager when the memory module is fully inserted;

wherein the second notch engager applies a second insertion force onto the second notch after the second levered handle is slid over the second axis to fit the second notch engager into the second notch and the second levered handle is rotated in an insertion movement, the second insertion force forcing the connector edge of the memory module firmly into the slot of the memory module socket;

wherein the first and second insertion forces are generated by the insertion movements of the first and second levered handles.

15. The reduced-insertion-force memory module socket of claim 14 wherein the first notch engager applies a first ejection force onto the first notch when the first levered handle is rotated in an ejection movement, the first ejection force forcing the connector edge of the memory module away from the slot of the memory module socket;

wherein the second notch engager applies a second ejection force onto the second notch when the second levered handle is rotated in an ejection movement, the second ejection force forcing the connector edge of the memory module away from the slot of the memory module socket; and wherein the first axis and the second axis are both substantially perpendicular to a plane of a component surface of the memory module when inserted.

16. The reduced-insertion-force memory module socket of claim 15 further comprising:

a first elongated slot on the first levered handle, the first elongated slot surrounding the first axis, the first axis sliding along the first elongated slot when the first levered handle is slid over the first axis to fit the first notch engager into the first notch; and a second elongated slot on the second levered handle, the second elongated slot surrounding the second axis, the second axis sliding along the second elongated slot when the second levered handle is slid over the second axis to fit the second notch engager into the second notch, whereby elongated slots allow levered handles to slide over axes.

17. The reduced-insertion-force memory module socket of claim 16 wherein the first and second levered handles slide in one or more planes substantially parallel to the plane of the component surface of the memory module when inserted.

18. The reduced-insertion-force memory module socket of claim 15 wherein the first and second levered handles slide in one or more planes substantially perpendicular to the plane of the component surface of the memory module when inserted.

19. The reduced-insertion-force memory module socket of claim 18 further comprising:

a first sliding ring on the first levered handle, the first sliding ring having a first hole that the first axis fits into, the first sliding ring sliding along the first axis;

wherein the first notch engager moves in a direction substantially perpendicular to the plane of the component surface of the memory module when the first notch engager is inserted to fit into the first notch; and a second sliding ring on the second levered handle, the second sliding ring having a second hole that the second axis fits into, the second sliding ring sliding along the second axis;

wherein the second notch engager moves in a direction substantially perpendicular to the plane of the component surface of the memory module when the second notch engager is inserted to fit into the second notch.

20. The reduced-insertion-force memory module socket of claim 19 wherein the first notch engager has a conical shape and wherein the second notch engager has a conical shape.

21. The reduced-insertion-force memory module socket of claim 19 further comprising:

a first rotating stop on the first levered handle, the first rotating stop contacting a first base stop on the first supporting mount to limit rotational motion of the first levered handle; and a second rotating stop on the second levered handle, the second rotating stop contacting a second base stop on the second supporting mount to limit rotational motion of the second levered handle, whereby rotational motion is limited by the first and second rotating stops.

22. The reduced-insertion-force memory module socket of claim 19 wherein the first notch engager has a rounded cross-sectional shape that at least partially matches a shape of the first notch on the memory module;

wherein the second notch engager has a rounded cross-sectional shape that at least partially matches a shape of the second notch on the memory module.

* * * * *